US009364023B1

(12) United States Patent
Nicholson

(10) Patent No.: US 9,364,023 B1
(45) Date of Patent: Jun. 14, 2016

(54) TOBACCO SMOKING HOLDER

(76) Inventor: Darrin J. Nicholson, Orlando, FL (US)

( * ) Notice: Subject to any disclaimer, the term of this patent is extended or adjusted under 35 U.S.C. 154(b) by 1040 days.

(21) Appl. No.: 13/418,553

(22) Filed: Mar. 13, 2012

(51) Int. Cl.

| | |
|---|---|
| ***A24F 3/00*** | (2006.01) |
| ***A24F 47/00*** | (2006.01) |
| ***A24F 13/06*** | (2006.01) |

(52) U.S. Cl.
CPC ..... *A24F 13/06* (2013.01)

(58) Field of Classification Search
None
See application file for complete search history.

(56) References Cited

U.S. PATENT DOCUMENTS

| | | | | |
|---|---|---|---|---|
| 2,546,128 | A * | 3/1951 | Lloyd | F23Q 2/34 431/136 |
| 5,472,001 | A * | 12/1995 | Nicholson | A24F 13/14 131/185 |
| 5,497,791 | A | 3/1996 | Bowen et al. | |
| 5,529,078 | A | 6/1996 | Rehder et al. | |
| 5,598,853 | A | 2/1997 | Hyre | |
| 5,752,527 | A | 5/1998 | Bowen et al. | |
| 5,813,705 | A * | 9/1998 | Dole | F16L 37/148 285/305 |
| 5,908,479 | A | 6/1999 | Wampole | |
| 6,006,757 | A | 12/1999 | Lichtenberg | |
| 6,012,459 | A | 1/2000 | Keefe | |
| 6,431,176 | B1 | 8/2002 | Rice | |
| 7,530,357 | B2 | 5/2009 | Edwards, Jr. | |
| 7,735,494 | B2 | 6/2010 | Bollinger et al. | |

FOREIGN PATENT DOCUMENTS

| | | |
|---|---|---|
| CN | 201226782 | 4/2009 |
| CN | 201805905 | 4/2011 |

* cited by examiner

*Primary Examiner* — Michael H Wilson
*Assistant Examiner* — Phu Nguyen
(74) *Attorney, Agent, or Firm* — Michael I. Kroll

(57) ABSTRACT

The present invention is a tobacco smoking holder for smoking a cigarette and filtering the tobacco byproducts from the air before emitting the clear air from the holder. The holder enables a user to mount the cigarette within the holder, light the cigarette while in the holder, smoke the cigarette while in the holder isolating the combustion byproducts through a motorized filtering assembly housed within a housing, which removes the cigarette's byproducts from the air before exhausting the air, thereby protecting others from secondary smoke and other products produced during smoking. When finished smoking, the cigarette is then extinguished while in the housing by an extinguishing canister that encompasses the lit end of the cigarette.

9 Claims, 13 Drawing Sheets

TOBACCO SMOKING HOLDER

BACKGROUND OF THE INVENTION

1. Field of the Invention

The present invention relates generally to smoking holders and, more specifically, to a tobacco smoking holder for smoking a cigarette and filtering the tobacco byproducts from the air before emitting the clear air from the holder.

The holder enables a user to mount the cigarette within the holder, light the cigarette while in the holder, smoke the cigarette while in the holder isolating the combustion byproducts through a motorized filtering assembly housed within a housing, which removes the cigarette's byproducts from the air before exhausting the air, thereby protecting others from secondary smoke and other products produced during smoking. When finished smoking, the cigarette is then extinguished while in the housing by an extinguishing canister that encompasses the lit end of the cigarette.

2. Description of the Prior Art

There are other smoking devices designed for smoking cigarettes therein. While these devices may be suitable for the purposes for which they where designed, they would not be as suitable for the purposes of the present invention as heretofore described.

It is thus desirable to provide a tobacco smoking holder for encapsulating a cigarette during smoking having a movable nose and mouth cup mask providing a secure seal to the user's face.

It is further desirable to provide a tobacco smoking holder having a housing incorporating an external lighter for igniting the cigarette while in the housing, a motor for creating a positive air flow from the nose and mouth cup mask to a filtering assembly and an extinguishing canister for extinguishing the cigarette.

SUMMARY OF THE PRESENT INVENTION

A primary object of the present invention is to provide a smoking tobacco holder for smoking a cigarette while containing the combustion byproducts within the holder.

Another object of the present invention is to provide a smoking tobacco holder having a tubular shaped housing having a first end and a second end for receiving the cigarette while being smoked.

Yet another object of the present invention is to provide a smoking tobacco holder wherein the second end has a vent point.

Still yet another object of the present invention is to provide a smoking tobacco holder incorporating a filtering assembly for removing cigarette smoke and other combustion byproducts while exhausting the air from the housing.

An additional object of the present invention is to provide a smoking tobacco holder incorporating a motor for causing a positive air flow from the nose and mouth cup mask through a filtering assembly and out vent ports in the housing.

A further object of the present invention is to provide a smoking tobacco holder incorporating a retainer for holding the cigarette within the housing during a smoking session.

A yet further object of the present invention is to provide a smoking tobacco holder incorporating a lighter for igniting the cigarette while contained in the housing.

A still yet further object of the present invention is to provide an external switch on the lighter for actuating the lighter.

Another object of the present invention is to provide a smoking tobacco holder having the nose and mouth cup mask on the second end of the housing.

Yet another object of the present invention is to provide a smoking tobacco holder incorporating a collar on the mouth and nose cup mask for sealing the first end of the housing to the smoker's face.

Still yet another object of the present invention is to provide a smoking tobacco holder, wherein the nose and mouth cup mask is spring tensioned to the second end of the housing, so that the smoker can push the mask against the face to gain access to a butt end of the cigarette that is faces away from the nose and mouth cup mask opening.

An additional object of the present invention is to provide a smoking tobacco holder having the filtering assembly for removing the cigarette byproduct from the air before exhausting the air from the housing.

A further object of the present invention is to provide a smoking tobacco holder having a power supply, a motorized fan and filtration elements for capturing the cigarette byproducts within the filtration elements before venting the air from the housing A yet further object of the present invention is to provide a smoking tobacco holder incorporating a component for extinguishing the cigarette when desired.

A still yet another object of the present invention is to provide a smoking tobacco holder having a movable canister for encapsulating the cigarette ember for extinguishing the cigarette when desired.

Another object of the present invention is to provide a smoking tobacco holder having an external hinged lighter for moving the cigarette extinguishing canister into engagement with the ember end of the cigarette.

Yet another object of the present invention is to provide a smoking tobacco holder that can be used with one hand grasping the housing with the lighter being actuated by the thumb of the hand grasping the housing.

Additional objects of the present invention will appear as the description proceeds.

The present invention overcomes the shortcomings of the prior art by providing a tobacco smoking holder that enables a user to mount a cigarette within the holder, light the cigarette while in the holder, smoke the cigarette in the holder while isolating the combustion byproducts within the holder, thereby protecting others from the smoke and other cigarette products, then extinguish the cigarette while in the holder when finished.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
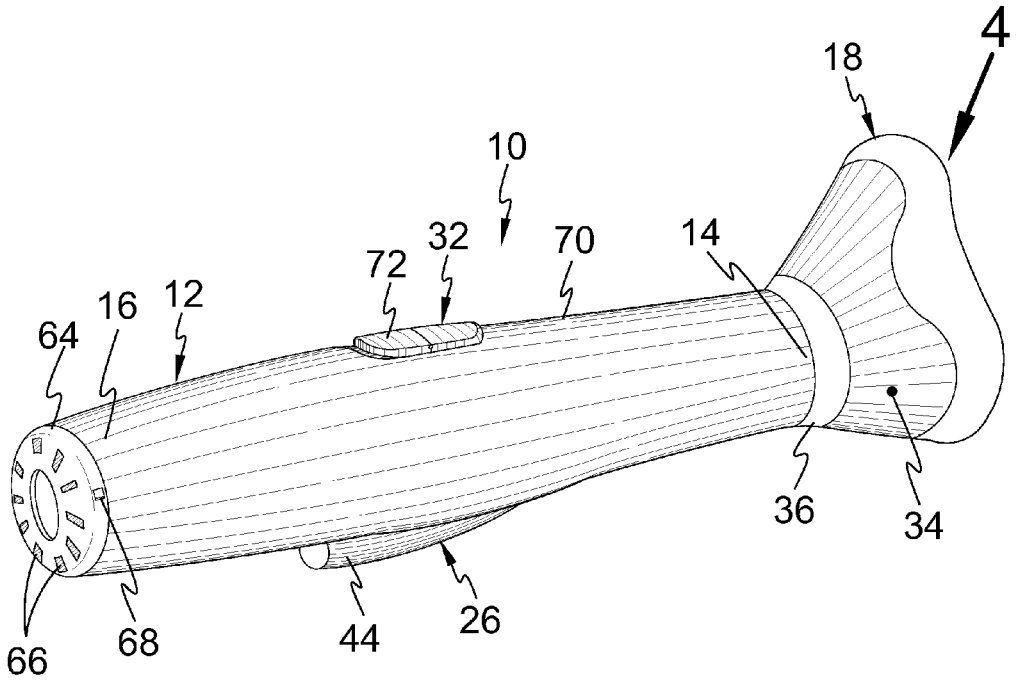
FIG. 1 is a perspective view of the present invention.
Figure 2:
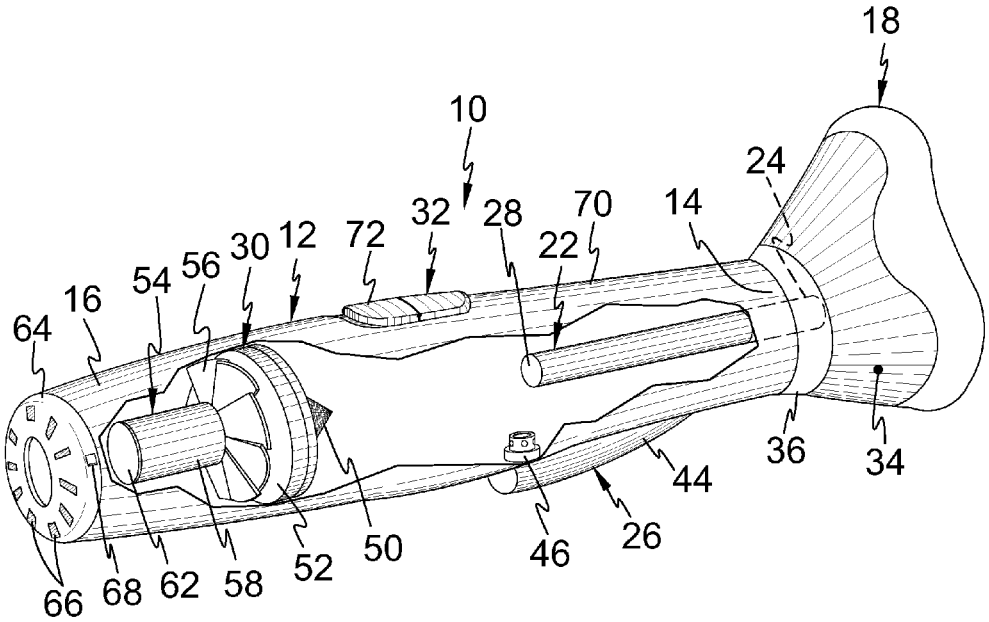
FIG. 2 is a perspective view similar to FIG. 1, cutaway and illustrating the various locations of the components therein.
Figure 3:
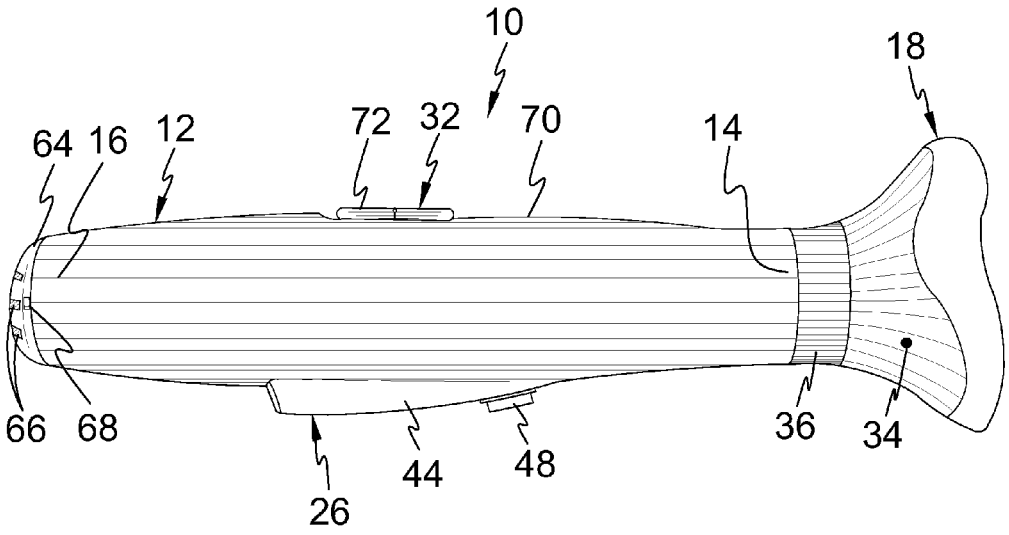
FIG. 3 is a side view of the present invention.

Turning now descriptively to the drawings, in which similar reference characters denote similar elements throughout the several views, the Figures illustrate the tobacco smoking holder of the present invention. With regard to the reference numerals used, the following numbering is used throughout the various drawing figures.

10 tobacco smoking holder
12 tubular housing of holder 10
14 first end of housing 12
16 second end of housing 12
18 cup mask of holder 10
20 retainer of holder 10
22 cigarette
24 butt end of cigarette 22
26 lighter of holder 10
28 distal end of cigarette 22
30 filtering assembly of holder 10
32 extinguisher of holder 10
34 durable pliable material of cup mask 18
36 collar of cup mask 18
38 spring of cup mask 18
40 central aperture in retainer 20
42 one way inlet valve in retainer 20
44 casing of lighter 26
46 igniter port of lighter 26
48 lighter switch of lighter 26
50 conical shaped ash screen of filtering assembly 30
52 filter disc of filtering assembly 30
54 exhaust unit of filtering assembly 30
56 fan blade of exhaust unit 54
58 motor of exhaust unit 54
60 shaft on motor 58
62 battery of exhaust unit 54
64 cap of exhaust unit 54
66 vent in cap 64
68 battery switch of exhaust unit 54
70 longitudinal slide track of extinguisher 32
72 hinged lever of extinguisher 32
74 extinguishing canister of extinguisher 32
76 linkage of extinguishing canister 74
78 ribbon seal of extinguisher 32

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

FIGS. 1 through 13 illustrate a tobacco smoking holder 10 which comprises a tubular housing 12 having a first end 14 and a second end 16. A cup mask 18 on the first end 14 of the housing 12 will cover the mouth and nose of a smoker (not shown). A retainer 20 secured in the first end 14 of the housing 10 will hold a cigarette 22 within the housing 10, whereby a butt end 24 of the cigarette 22 can extend into the cup mask 18. A lighter 26 in the housing 10 will ignite a distal end 28 of the cigarette 22 within the housing 12 when the smoker inhales. A filtering assembly 30 on the second end 16 of the housing 12 will filter out harmful smoke coming from the lit distal end 28 of the cigarette 22 and the smoker, so as to prevent the harmful smoke from exiting the housing 12 and reaching the ambient air. An extinguisher 32 in the housing 10 will put out the lit distal end 28 of the cigarette 22 when the smoker is done smoking the cigarette 22.

Figure 4:
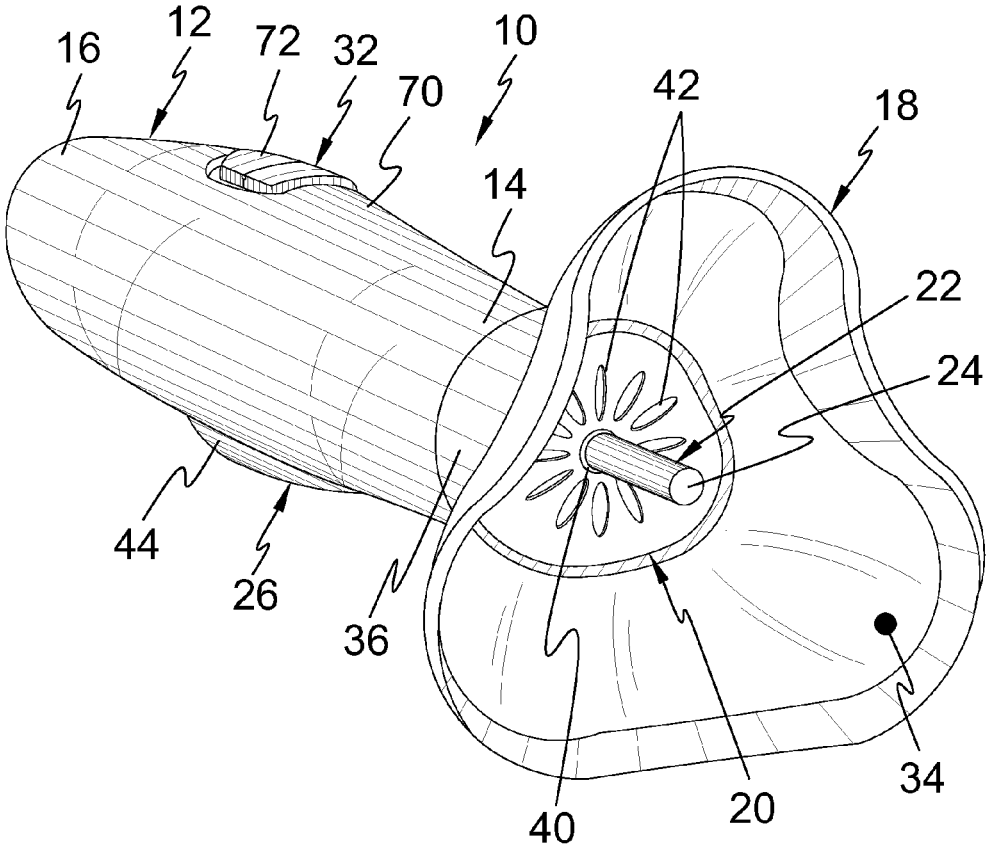
FIG. 4 is a rear perspective view taken in the direction of arrow 4 in FIG. 1 with the cigarette placed therein.
Figure 5:
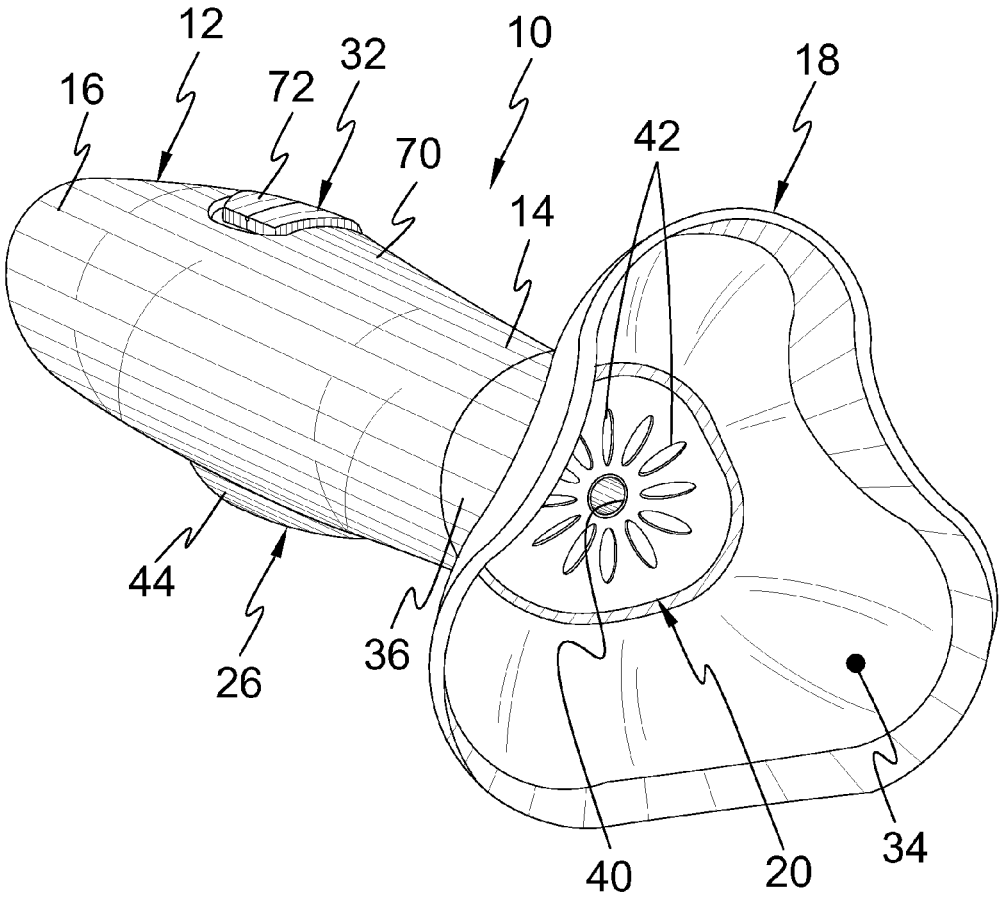
FIG. 5 is a rear perspective view similar to FIG. 4, with the cigarette removed therefrom.
Figure 6:
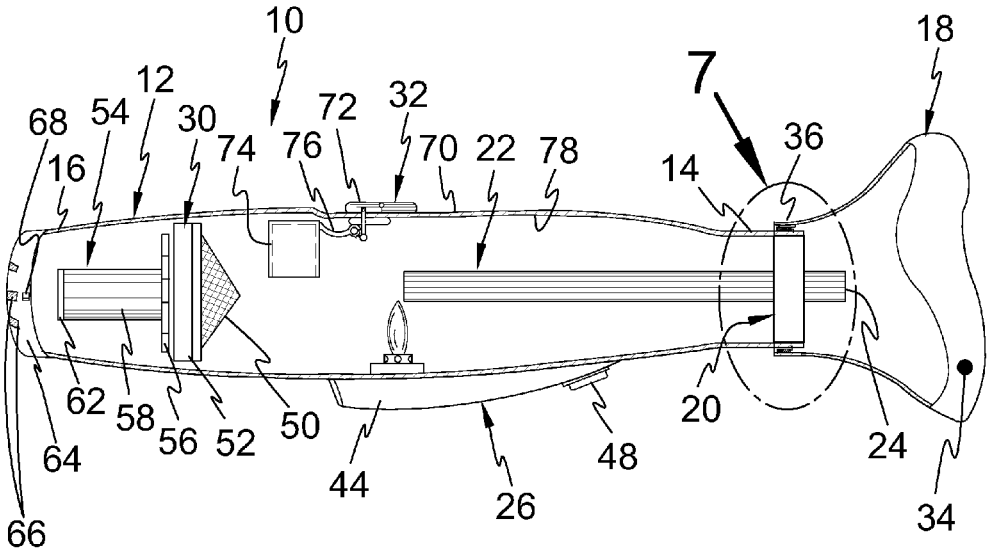
FIG. 6 is a side cross sectional view of the present invention illustrating the operation of the lighter.
Figure 7:
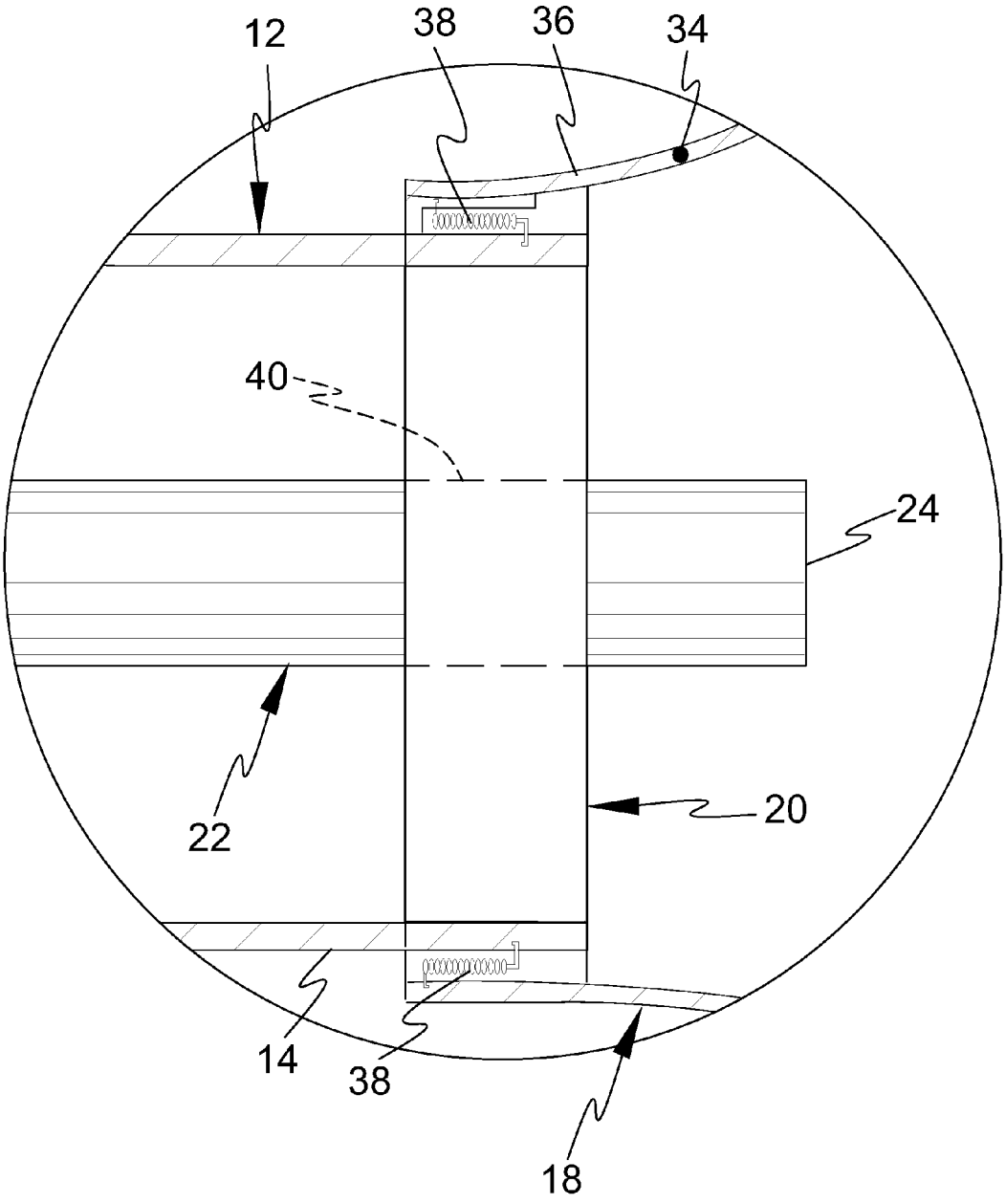
FIG. 7 is an enlarged is an enlarged cross sectional view of the area indicated by arrow 7 in FIG. 6.
Figure 8:
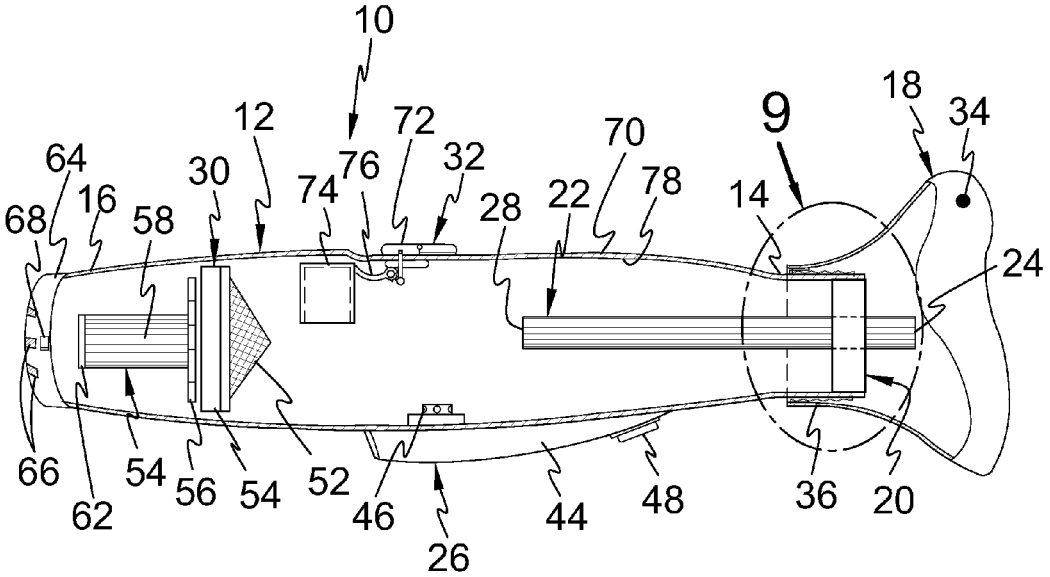
FIG. 8 is a side cross sectional view of the present invention, illustrating the inward movement of the nose and mouth cup mask.
Figure 9:
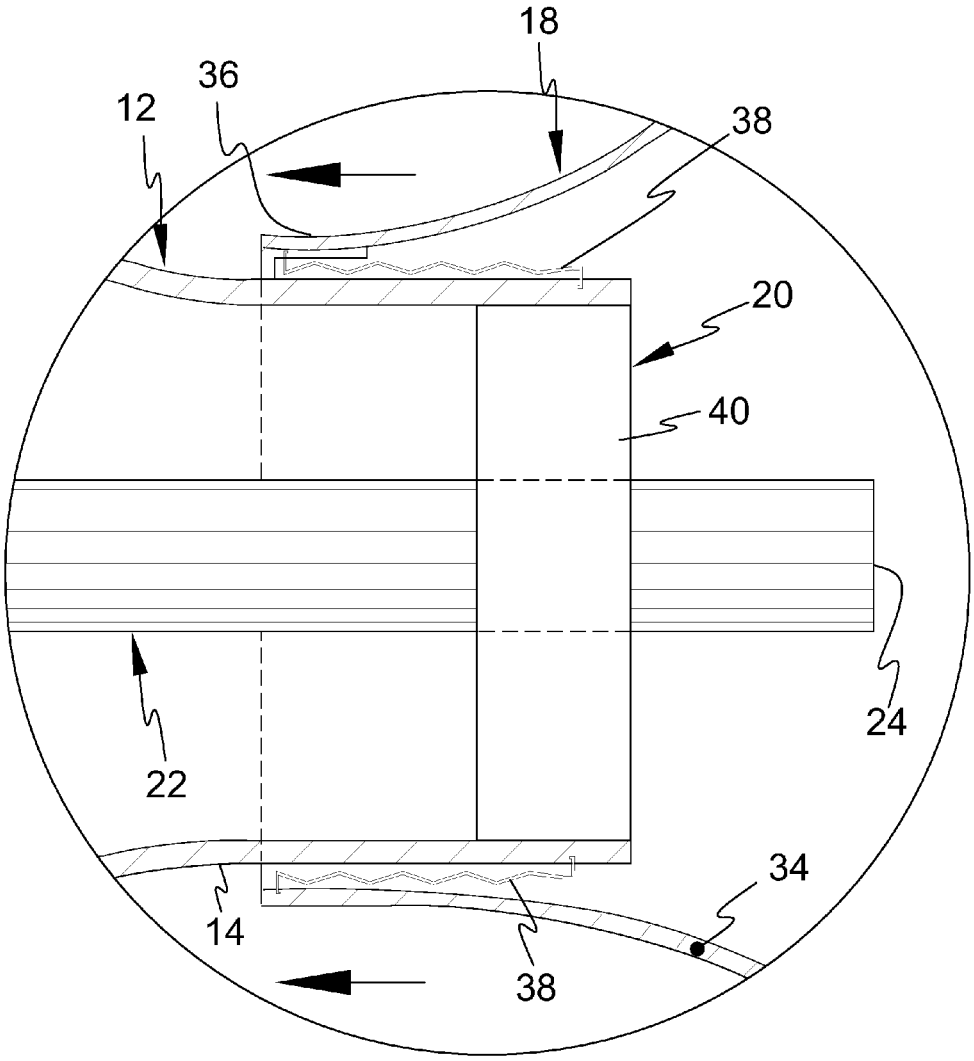
FIG. 9 is an enlarged cross sectional view of the area indicated by arrow 9 in FIG. 8.
Figure 10:
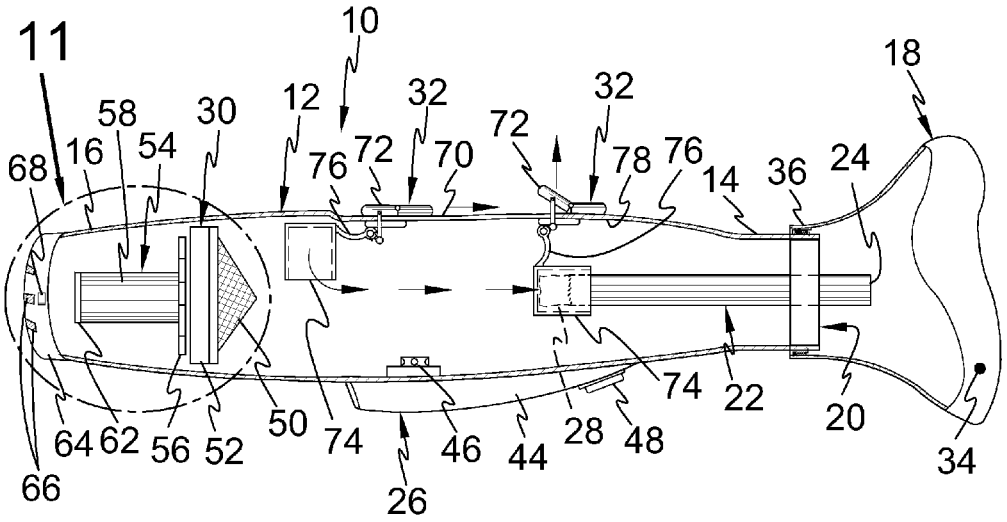
FIG. 10 is a side cross sectional view of the present invention, illustrating the operation of the cigarette extinguishing canister.
Figure 11:
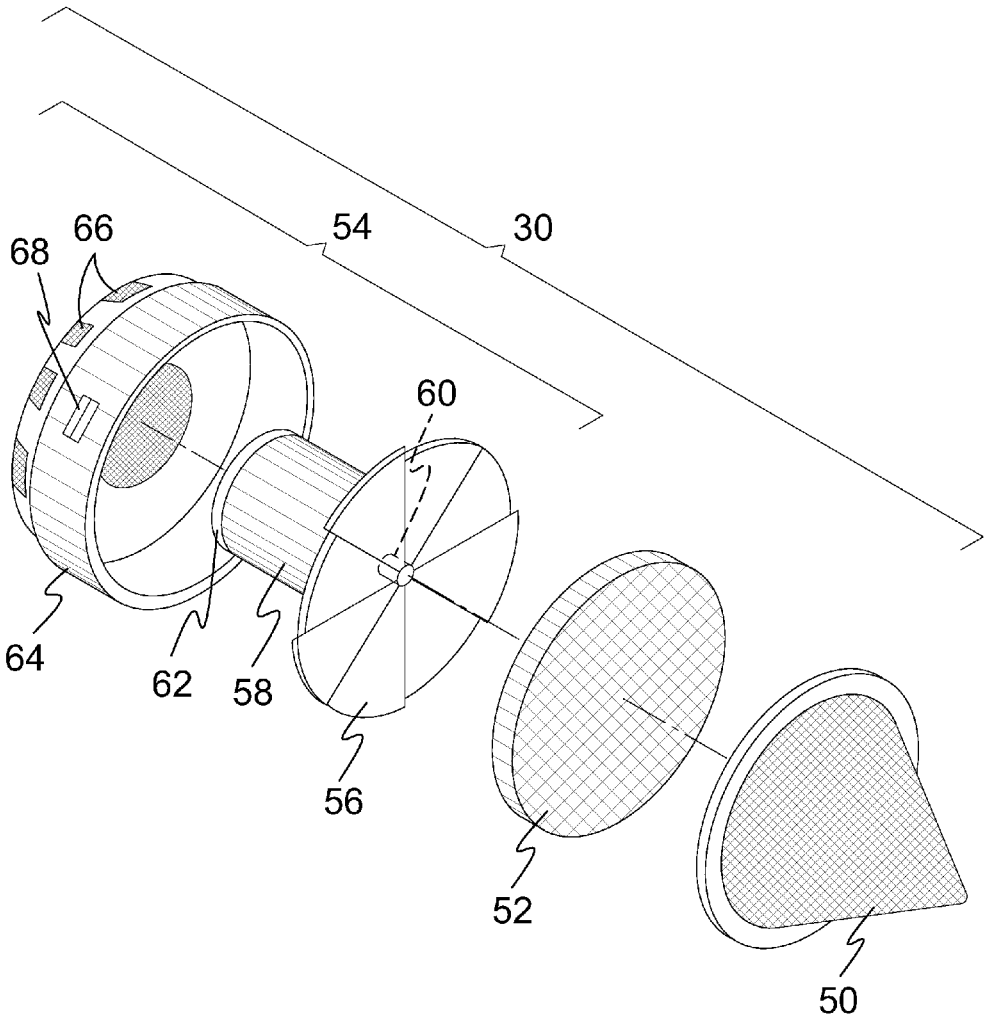
FIG. 11 is an enlarged exploded perspective view of the area indicated by arrow 11 in FIG. 10.

The cup mask 18 is comprised of a durable pliable material 34 to snugly conform to a face of the smoker. The cup mask 18 further comprises a collar 36 that fits over the first end 14 of the housing 12. As best seen in FIGS. 7 and 9, at least two springs 38 extend between the collar 36 and the first end 14 of the housing 12 to allow the cup mask 18 to be adjustable over the mouth and the face of the smoker. As best seen in FIGS. 4 and 5, the retainer 20 includes a central aperture 40 to hold the cigarette 22 therein and a plurality of radially positioned one way inlet valves 42 about the aperture 40 to allow smoke filled air coming from the smoker to enter the housing 12.

The lighter 26 includes a casing 44 affixed to an exterior surface of the housing 12. An igniter port 46 extends from the casing into the housing 12. A lighter switch 48 is on the casing 44, whereby when the lighter switch 48 is activated the igniter port 46 will produce a flame to light the distal end 28 of the cigarette 22.

The filtering assembly 30 consists of a conical shaped ash screen 50 carried within the second end 16 of the housing 12 for collecting ashes from the lit distal end 28 of the cigarette 22. A filter disc 52 carried within the second end 16 of the housing 12 behind the conical shaped ash screen 50 is capable of filtering the cigarette smoke from the air within the housing 12. An exhaust unit 54 is carried within the housing 12 behind the filter disc 52. The exhaust unit 54 will expel filtered air into the ambient air outside of the housing 12.

Figure 12:
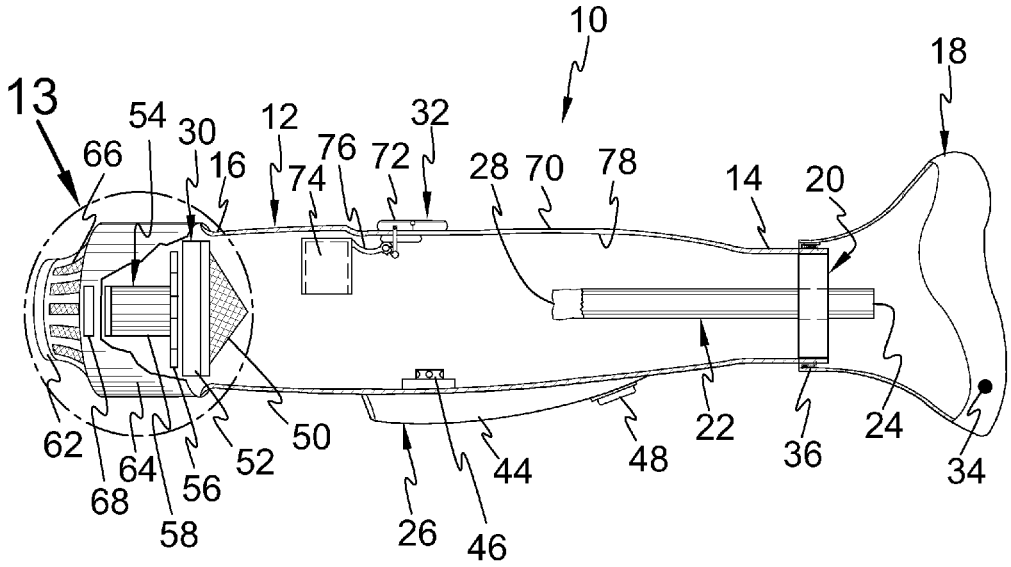
FIG. 12 is a side cross sectional view illustrating an alternate embodiment of the filtering assembly of the present invention.
Figure 13:
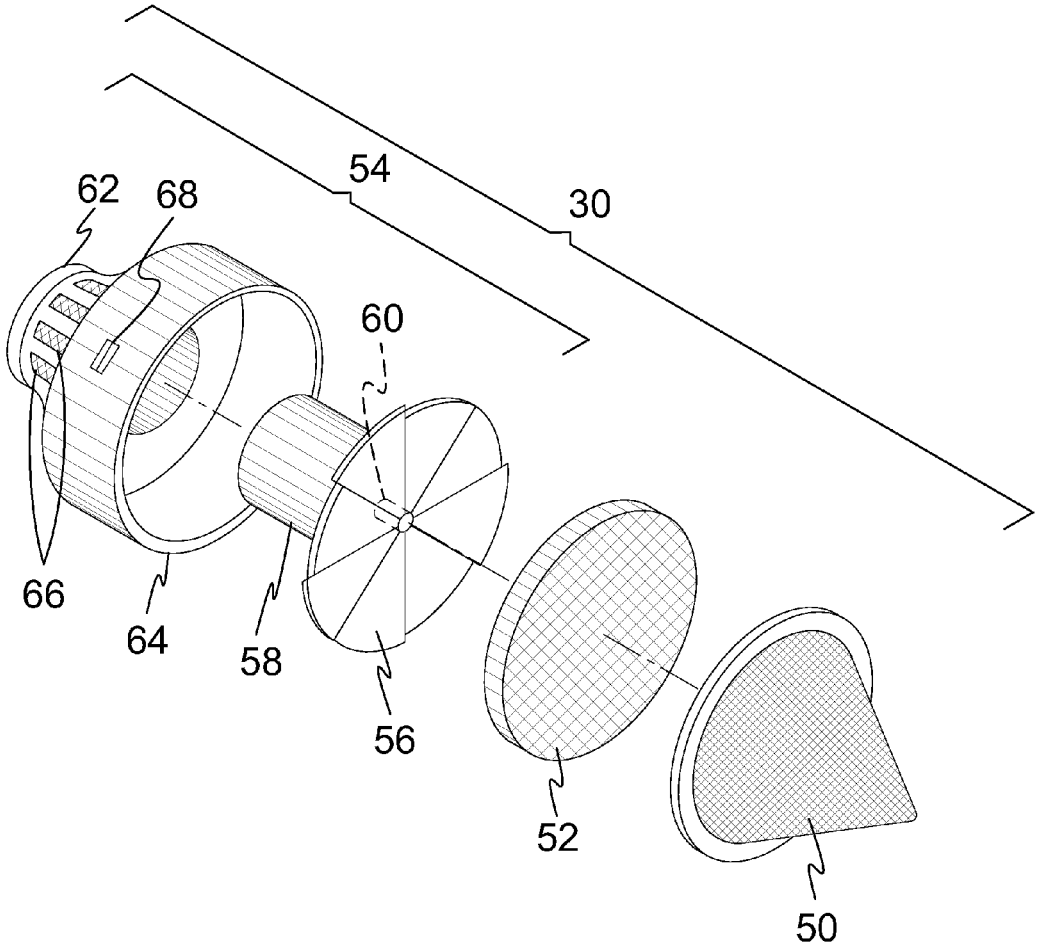
FIG. 13 is an enlarged exploded perspective view of the area indicated by arrow 13 in FIG. 12.

The exhaust unit 54 comprises a plurality of fan blades 56 carried within the housing 12 behind the filter disc 52. A motor 58 has a shaft 60 connected centrally to the fan blades 56. A battery 62 is electrically connected to the motor 58. A cap 64 has a plurality of vents 66 and is mounted onto the second end 16 of the housing 12. A battery switch 68 on the cap 64 is electrically connected to the battery 60 to turn the motor 58 on and allow the filtered air to be expelled from the vents 64 in the cap 62. FIGS. 12 and 13 show a modification in which the battery 62 can be mounted centrally onto an exterior surface of the cap 64.

The extinguisher 32 consists of the housing 12 having a longitudinal slide track 70 extending an entire length of the housing 12. A hinged lever 72 rides in the slide track 70, whereby the lever 72 extends above the slide track 70. An extinguishing canister 74 has linkage 76 coupled to the hinged lever 72. When the hinged lever 72 is manually lifted the extinguishing canister 74 will swing down via the linkage 76 to engage with the lit distal end 28 of the cigarette 22 to put out the lit distal end 28. A ribbon seal 78 covers the slide track 70 to prevent the escape of the cigarette smoke from the housing 12.

What is claimed is:

1. A tobacco smoking holder which comprises:

a) a tubular housing having a first end and a second end;

b) a cup mask on the first end of the housing to cover the mouth and nose of a smoker, said cup mask having a collar overlapping said first end of said housing, a plurality of springs between said collar and said first end of said housing, each spring having a first end thereof attached to said collar adjacent an open end thereof and a second end of said spring attached to said housing adjacent an opening into said first end of said housing adapting said cup mask to be adjustable over the mouth and face of the smoker;

c) a retainer secured in the first end of the housing to hold a cigarette within the housing, whereby a butt end of the cigarette can extend into the cup mask, said retainer including a central aperture to hold the cigarette therein and a plurality of radially positioned one way inlet valves about the aperture to allow smoke filled air coming from the smoker to enter the housing;

d) a lighter in the housing to ignite a distal end of the cigarette within the housing when the smoker inhales; and e) a filtering assembly on the second end of the housing to filter out harmful smoke coming from the lit distal end of the cigarette and the smoker, so as to prevent the harmful smoke from exiting the housing and reaching the ambient air.

2. The holder as recited in claim 1, further comprising an extinguisher in the housing to put out the lit distal end of the cigarette when the smoker is done smoking the cigarette.

3. The holder as recited in claim 2, wherein the extinguisher comprises:

a) the housing having a longitudinal slide track extending an entire length of the cigarette;

b) a hinged lever to ride in the slide track, whereby the lever extends above the slide track;

c) an extinguishing canister having linkage coupled to the hinged lever, whereby when the hinged lever is manually lifted the extinguishing canister will swing down via the linkage to engage with the lit distal end of the cigarette to put out the lit distal end; and d) a ribbon seal covering the slide track to prevent the escape of the cigarette smoke from the housing.

4. The holder as recited in claim 1, wherein the cup mask is comprised of a durable pliable material to snugly conform to a face of the smoker.

5. The holder as recited in claim 1, wherein the lighter comprises:

a) a casing affixed to an exterior surface of the housing;

b) an igniter port extending from the casing into the housing; and c) a lighter switch on the casing, whereby when the lighter switch is activated the igniter port will produce a flame to light the distal end of the cigarette.

6. The holder as recited in claim 1, wherein the filtering assembly comprises:

a) a conical shaped ash screen carried within the second end of the housing for collecting ashes from the lit distal end of the cigarette; and b) a filter disc carried within the second end of the housing behind the conical shaped ash screen capable of filtering the cigarette smoke from the air within the housing.

7. The holder as recited in claim 6, wherein the filtering assembly further comprises an exhaust unit carried within the housing behind the filter disc, whereby the exhaust unit will expel filtered air into the ambient air outside of the housing.

8. The holder as recited in claim 7, wherein the exhaust unit comprises:

a) a plurality of fan blades carried within the housing behind the filter disc;

b) a motor having a shaft connected centrally to the fan blades;

c) a battery electrically connected to the motor;

d) a cap having a plurality of vents mounted onto the second end of the housing; and e) a battery switch on the cap electrically connected to the battery to turn the motor on and allow the filtered air to be expelled from the vents in the cap.

9. The holder as recited in claim 8, wherein the battery is mounted centrally onto an exterior surface of the cap and surrounded by said vents.

* * * * *